United States Patent [19]

Bertozzi

[11] Patent Number: 4,893,814

[45] Date of Patent: Jan. 16, 1990

[54] PLASTIC CANDLEPIN CONSTRUCTION

[76] Inventor: Albert N. Bertozzi, P.O. Box 478, Pawtucket, R.I. 02860

[21] Appl. No.: 153,354

[22] Filed: Feb. 8, 1988

[51] Int. Cl.[4] ..... A63B 9/00

[52] U.S. Cl. ..... 273/82 R; 273/82 B

[58] Field of Search ..... 273/82 B, 82 R

[56] References Cited

U.S. PATENT DOCUMENTS

| | | | |
|---|---|---|---|
| 3,201,124 | 8/1965 | Halip | 273/82 A |
| 3,231,274 | 1/1966 | Wanders | 273/82 R |
| 3,232,614 | 2/1966 | Abbat | 273/82 A |
| 3,329,430 | 7/1967 | Wanders | 273/82 R |
| 3,984,104 | 10/1976 | Negrini | 273/82 R |
| 4,351,530 | 9/1982 | Bertozzi | 273/82 R |

*Primary Examiner*—Edward M. Coven
*Assistant Examiner*—Gary Jackson
*Attorney, Agent, or Firm*—Barlow & Barlow Ltd.

[57] ABSTRACT

A candlepin has a central section that contains a dense weight material and has a thinned portion adjacent each of its bases substantially at the strike zone thereof to give the pin a more lively action.

2 Claims, 1 Drawing Sheet

PLASTIC CANDLEPIN CONSTRUCTION

BACKGROUND OF THE INVENTION

This invention relates to candlepins which are primarily popular in the New England area. Candlepins originally were made of maple but a wooden pin such as this has a rather short life particularly since in candlepin bowling, the dead wood is not removed from the lane. To overcome this problem, candlepins are now extruded of a high density polyethylene and are tubular in nature with an outside dimension conforming to the International Candlepin Bowling Association. The specifications are a maximum weight of 40 oz., a length of 15.75 inches, and a maximum diameter of 2.937 inch at the center that tapers to 1.75 inch at each end. Because of these specifications conventional candlepins are thick wall tubes which then are shaped to the deired dimensions. It is desirable to produce a plastic bowling pin with improved characteristics that will improve the scoring capabilities of the candlepin within the conform of the Association specifications.

SUMMARY OF THE INVENTION

In a effort to improve scoring, this invention is directed to the concept of molding a tubular candlepin in two seperate sections and removing weight by reducing the wall thickness. The removed weight is then concentrated at the center of the pin with a material that has a density much greater than the high density polyethylene. To further add to the liveliness, additional material is removed from the inner surface of the wall at the ball strike zone which provides a thinner wall at the impact point.

A plastic candlepin is made of a substantially rigid material such as a high density polyethylene and is moulded in two hollow sections with interlocking end walls that abut each other. The inner wall is formed to accept adjacent the interlocking end walls a weighted material or, broadly, material which has a density much greater than the polyethlene material by 100 fold or more and the interlocking end walls are then joined together by a spin welding process. The outer ends of the joined candlepin are formed with suitable counter bores into which nylon end caps are placed. The inner walls adjacent the outer ends are counterbored to remove weight. By suitably selecting the amount of weight added, which is substantially at the center, a more lively pin is created. Additionally, by providing counterbores, substantially at the ball line strike area, more bounce of the pin is created.

DESCRIPTION OF THE PREFERRED EMBODIMENT

Figure 1:
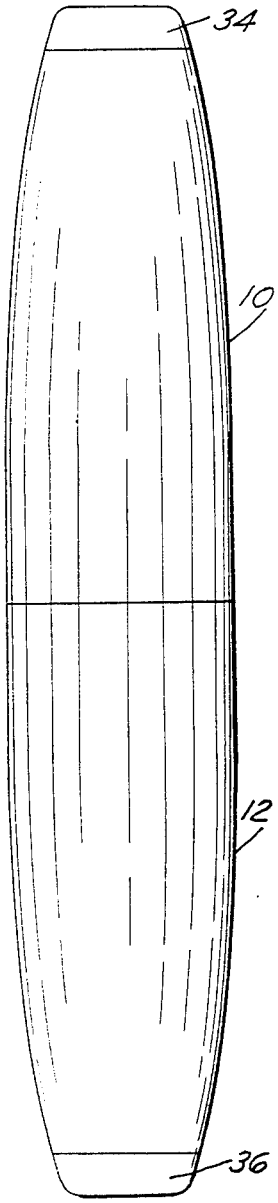
FIG. 1 is an elevational view of a candlepin.
Figure 2:
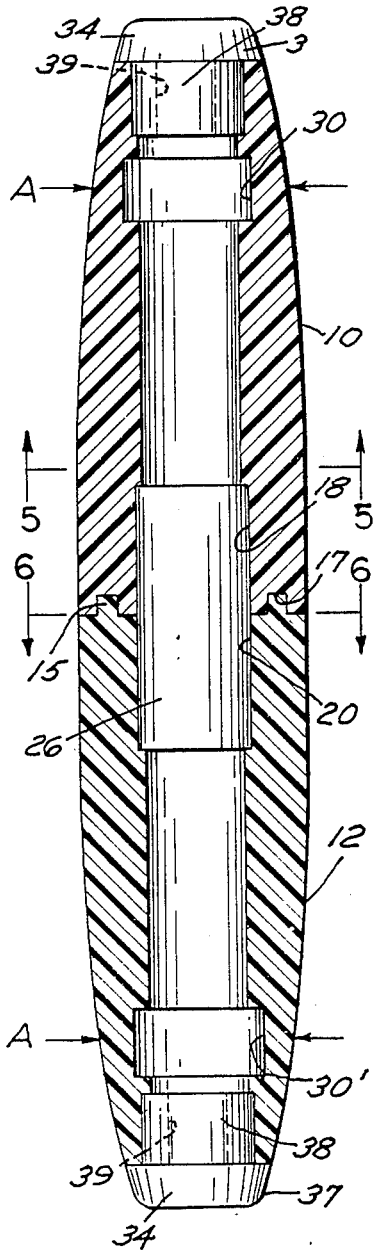
FIG. 2 is a elevational view showing in section the various features of the invention.
Figure 4:
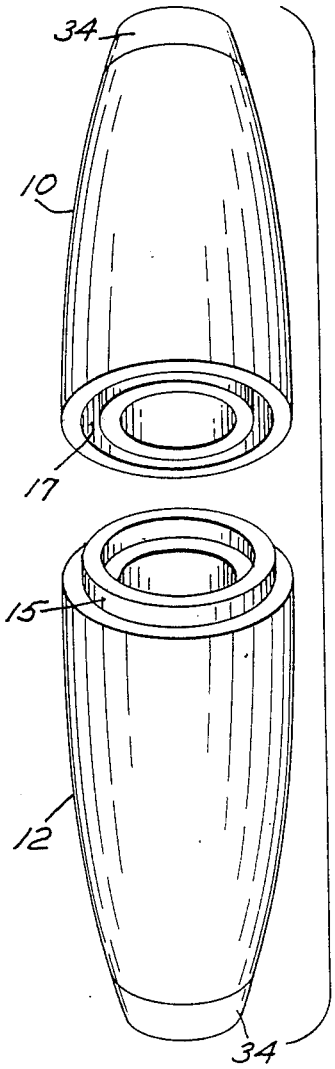
FIG. 4 is a detached perspective view of the two sections.
Figure 5:
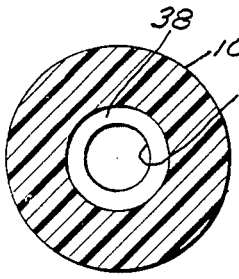
FIG. 5 is a sectional view taken on line 5—5 of FIG. 1.

The pin ilustrated in FIGS. 1 and 2 consists essentially of two principal parts, 10 and 12, which are preferably molded from high density polyethylene which has a high molecular weight and a density in the range of 0.94 g/cm$^3$ (20° C.). Both of the parts are hollow and are separately molded so as to provide one portion 12 with a circular ridge 15, and the other portion 10 with a circular recess 17 to receive the ridge. The two parts as mentioned are hollow and to redistribute the weight, counterbores 18 and 20 remove additional wall thickness and provide essentially a shelf area to support a weight 26 made out of very dense material such as iron, lead or the like.

The balls that are utilized for a candlepin have a finite size which is specified as being no more than 2.4375 pounds and, have a diameter of 4.50 inches. This means that we have a known strike area on the pin which is designated at arrow A and, at this strike area, counter bores 30, 30' have been created which assist in giving the candlepin more bounce as a thinner wall is provided at this particular point. To complete the candlepin, bases are formed with end caps such as 34, 36, which are molded to fit into the ends of the pin in a suitable fashion, and which form no part of this invention, but which, by way of example, may engage the annular ends of the pin body and the peripheral surface 37 is tapered to form a suitable continuation of the outer surface of the pin body. The end caps may, if desired, have a cylindrical portion 38 that fit within the hollow pin body and the same may be suitably bored as at 39 to control the weight and may be secured into place by suitable techniques.

Figure 3:
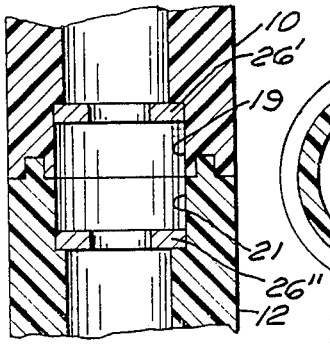
FIG. 3 is a sectional view of a modified form of a weight area.
Figure 6:
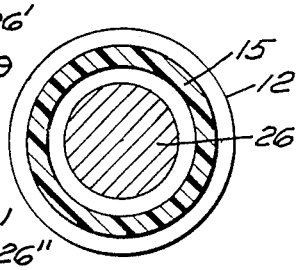
FIG. 6 is a sectional view taken on line 6—6 of FIG. 2.

A modified form of a bowling pin where less central weight is added is seen in FIG. 3 where the abutting ends of the pin body are formed with smaller counter bores as at 19 and 21 and secured to the counter bores are disc weights such as 26', 26''. All of the other features remain the same.

There is thus provided a novel candlestick bowling pin which is made substantially wholly of a thermoplastic material that is sturdy, resistant to shock, and, due to its particular structure, has more bounce and liveliness than bowling pins heretofore used by removing wall thickness and placing the weight at the center of the pin. Similarly, the pin can be readily made to conform to the standards of the International Candlestick Bowling Association, referred to above.

I claim:

1. A bowling pin having a body defining curved sides tapering from a central portion to each end, said pin having two mating halves joined at a medial point by interlocking edges, said pin having a substantially hollow core defined by hollow walls, said central portion having a central counterbore extending inwardly from the mating interlocking edges, said central portion containing dense material secured to the hollow walls thereof, bases affixed to each end of said body closing the hollow core, the hollow walls remote from the inner portion of the bases being thinned substantially at the strike zone thereof to provide a lively pin, the thinning and central counterbore compensating for the weight added at the central portion of the pin said dense weight equaling the removed material from the core of the pin.

2. In a molded bowling pin of substantially rigid material having a first and second substantially cylindrical hollow sections arranged in abutting end to end relationship defining a central bore and having two bases upon which the pin may rest that improvement comprising recesses in the central bore of each section, said recesses located adjacent to but removed from the bases to define thin walls sections at the strike zone of the pin and at the section ends remote from the bases, a weight located and secured to the walls of the cylinder substantially centrally of the longitudinal extent of the pin and adjacent to the joined ends in the central bore, said weight having a density much greater than the material of the pin to achieve a less stable pin whereby the total pin weight is maintained within the maximum allowed by the removal of material within the central bore that creates recesses.

* * * * *